United States Patent [19]

Hinata et al.

[11] 3,994,733

[45] Nov. 30, 1976

[54] SILVER HALIDE PHOTOGRAPHIC EMULSION

[75] Inventors: Masanao Hinata; Masanaga Ohki; Reiichi Ohi; Akira Ogawa; Akira Sato, all of Minami-ashigara, Japan

[73] Assignee: Fuji Photo Film Co., Ltd., Minami-ashigara, Japan

[22] Filed: Dec. 10, 1974

[21] Appl. No.: 531,416

[30] Foreign Application Priority Data

Dec. 10, 1973 Japan ..... 48-140091

[52] U.S. Cl. ..... 96/126; 96/109

[51] Int. Cl.[2] ..... G03C 1/14

[58] Field of Search ..... 96/126, 109

[56] References Cited

UNITED STATES PATENTS

| | | | |
|---|---|---|---|
| 2,398,778 | 4/1946 | Carroll et al. | 96/126 |
| 2,533,426 | 12/1950 | Carroll et al. | 96/126 |
| 2,848,329 | 8/1958 | Chechak et al. | 96/126 |
| 2,945,763 | 7/1960 | Jones | 96/126 |
| 3,669,672 | 6/1972 | Shiba et al. | 96/126 |

*Primary Examiner*—J. Travis Brown

*Attorney, Agent, or Firm*—Sughrue, Rothwell, Mion, Zinn & Macpeak

[57] ABSTRACT

A silver halide photographic emulsion containing the combination of (i) at least one cyanine dye wherein two basic 5-membered and/or 6-membered nitrogen-containing heterocyclic nuclei are linked by methine groups having an odd number of carbon atoms not exceeding 7 and the substituents on the nitrogen atoms in the heterocyclic nuclei are aliphatic groups or aromatic groups with at least one of the substituents on the nitrogen atom being an alkyl group having a sulfo group or a carboxyl group, and (ii) at least one substantially colorless nitrogen-containing heterocyclic organic base selected from the group consisting of a benzothiazole, a benzothiazolone, a naphthothiazole, a naphthothiazolone, and a quinolone in a quantity sufficient to supersensitize.

8 Claims, 9 Drawing Figures

SILVER HALIDE PHOTOGRAPHIC EMULSION

BACKGROUND OF THE INVENTION

1. Field of the Invention

This invention relates to a spectrally sensitized silver halide photographic emulsion and in particular, to a supersensitized silver halide photographic emulsion and, moreover, it is concerned with a process for the production of a supersensitized photographic emulsion, which process is suitable for obtaining good "color balance" and high sensitivity of a panchromatically sensitized or orthchromatically sensitized emulsion without deteriorating the stability thereof. To determine whether the color balance in the case of photographing with a light source, for example, a tungsten lamp, is exact or not a neutral grey object (having a constant value of spectral reflection factor or transmissivity over a range of visible wavelengths) is photographed under a tungsten light source, the coordinates of the reproduced color on the C. I. E. chromaticity diagram (see Theory of Color Reproduction, translated by Mawatari Tsutomu and Kokushi Tatsuro, 1971, p 10–26 and p 160–162) are determined and this point is compared with the point corresponding to the light source on the C. I. E. chromaticity diagram.

2. Description of the Prior Art

In the technique of producing silver halide photographic emulsions, it has been desired to sensitize spectrally these emulsions as effectively as possible and many studies for improvements have been made. In lithographic light-sensitive materials or color print light-sensitive materials, photographic emulsions capable of providing not only a high sensitivity but also a high contrast image have been desired. Silver chlorobromide emulsions or silver chloroiodobromide emulsions, in general, are capable of providing a higher contrast image than silver iodobromide emulsions and are superior in that there are no particular problems in the progress of chemical ripening or development. That is to say, development of silver iodobromide emulsions progresses more slowly and a lower contrast image as compared with silver chlorobromide emulsions and silver chloroiodobromide emulsions is obtained. In addition to the step of preparing an emulsion, silver iodobromide emulsions require a long water washing step because chemical ripening is difficult to progress unless water washing is carried out prior to chemical ripening or second ripening.

SUMMARY OF THE INVENTION

An object of this invention is to provide a silver halide photographic emulsion whose spectral sensitivity is effectively increased.

Another object of this invention is to provide a silver halide photographic emulsion capable of providing a high contrast image.

A further object of this invention is to provide a process for the production of the above described photographic emulsion.

It has now been found that the above described objects are effectively accomplished by a silver halide photographic emulsion containing in supersensitizing amounts (i) at least one cyanine dye wherein two basic (5-membered and/or 6-membered) nitrogen-containing heterocyclic nuclei are linked by methine groups (chain) of an odd number of carbon atoms not exceeding 7 and the substituents on the nitrogen atoms in the hetrocyclic nuclei are saturated or unsaturated aliphatic groups or aromatic groups, at least one of which is an alkyl group having a sulfo group or a carboxyl group, and (ii) at least one substantially colorless nitrogen-containing heterocyclic organic base selected from the benzothiazoles, the benzothiazolones, the naphthothiazoles, the naphthothiazolones and the quinolones.

BRIEF DESCRIPTION OF THE DRAWINGS

FIG. 1 shows the spectrum of supersensitization with the combination of Sensitizing Dye (I) and Compound (A) of Example 1, FIG. 2 shows the spectrum of supersensitization with the combination of Sensitizing Dye (IV) and Compound (C) of Example 1, FIG. 3 shows the spectrum of supersensitization by the combination of Dye (I) and Quinolone (a) of Example 1, FIG. 4 shows the spectrum of supersensitization with the combination of Sensitizing Dye (IV) and Quinolone (c) of Example 1, FIG. 5 shows the spectrum of supersensitization with the combination of Sensitizing Dye (IV) and Compound (B) of Example 2, and FIG. 6 shows the spectrum obtained with the combination of Sensitizing Dye (1) for comparison with Compound (B).

In these Figures, the solid line shows the spectrum obtained with only a sensitizing dye, while the dotted line shows the spectrum obtained with the combination of a sensitizing dye and benzothiazole.

Figure 7:
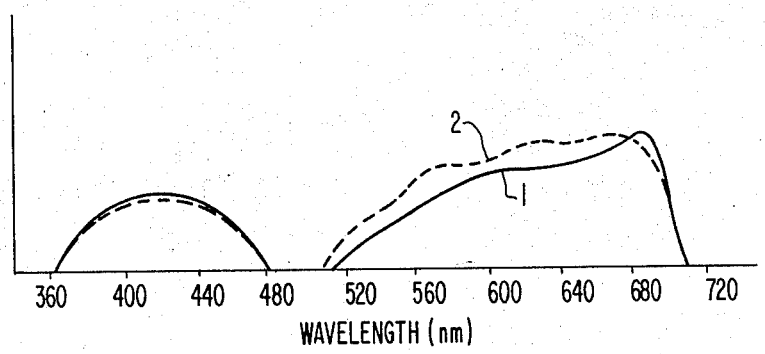
Figure 8:
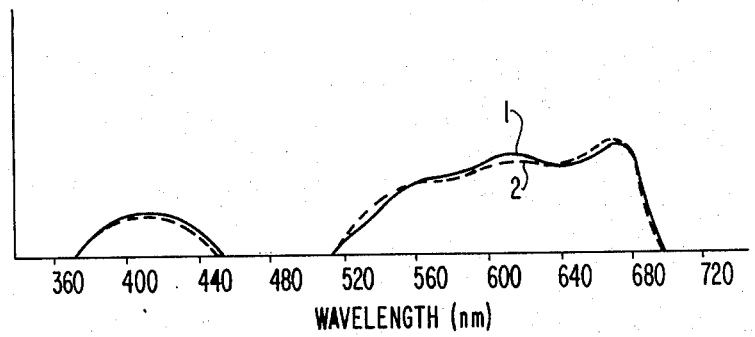
Figure 9:
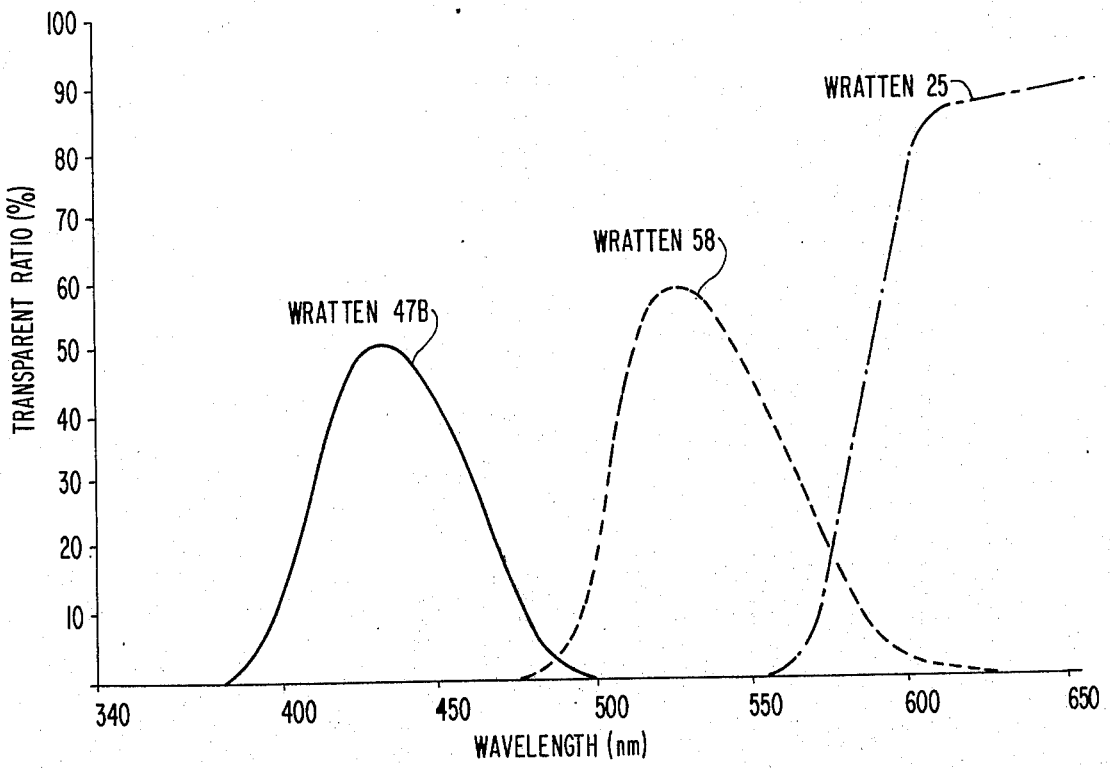

FIG. 7 shows the supersensitization spectrum with the combination of Sensitizing Dye (IV) and Quinolone (b) of Example 2, FIG. 8 shows the spectrum obtained with the combination of Sensitizing Dye (1) for comparison and quinolone (b) and FIG. 9 shows the spectral transmission of Wratten filters No. 25, 58 and 47B used for the measurement of spectral sensitivity.

DETAILED DESCRIPTION OF THE INVENTION

The cyanine dye used in the invention is represented by the following general formula (I),

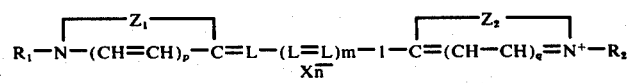

(I)

in which (a) $m$ is 1, 2, 3 or 4, (b) $n$ is 0 or 1, (c) $p$ is 0 or 1 and $q$ is 0 or 1 and (d) $R_1$ and $R_2$ which can be the same or different, each represents an aliphatic group (saturated or unsaturated) or an aromatic group, for example, substituted or unsubstituted alkyl groups having 1 to 18 carbon atoms and substituted or unsubstituted aryl groups. Examples of aliphatic groups are unsubstituted alkyl groups, preferably, having 1 to 4 carbon atoms, such as methyl, ethyl, propyl, isopropyl, butyl, sec-butyl, tert-butyl, pentyl, hexyl, octyl, decyl, dodecyl and octadecyl groups, aralkyl groups such as benzyl and phenethyl groups, sulfo group-containing lower alkyl groups, e.g. sulfoalkyl groups such as 2-sulfoethyl, 3-sulfopropyl, 3-sulfobutyl and 4-sulfobutyl groups and alkyl groups substituted with a sulfo group and at least one of a hydroxyl, alkoxy and acetoxy group, such as 2-hydroxy-3-sulfopropyl, 2-(3-sulfopropoxy)ethyl, 2-acetoxy-3-sulfopropyl, 3-methoxy-2-(3-sulfopropoxy)propyl, 2-(2-(3-sulfopropoxy)ethoxy)ethyl and 2-hydroxy-3-(3'-sulfopropoxy)propyl groups, carboxy group-containing lower alkyl groups, e.g. carboxyalkyl groups such as 2-carboxyethyl, 3-carboxypropyl and 4-carboxybutyl groups and alkyl groups substituted with a carboxy group and an alkoxy group, such as a 2-(2-carboxyethoxy)ethyl group, sulfonato lower alkyl groups such as 2-sulfonatoethyl, 3-sulfonatopropyl and 4-sulfonatobutyl groups, lower alkoxy lower alkyl groups such as 2-methoxyethyl, 3-methoxypropyl and 4-propoxybutyl groups, acyloxy alkyl groups (e.g., having 1 to 4 carbon atoms in the alkyl moiety) such as acetyloxyethyl, propanoyloxyethyl, butanoyloxybutyl, benzoyloxyethyl and tolyloxypropyl groups, lower alkoxycarbonyl lower alkyl groups such as 2-methoxycarbonylethyl, 4-ethoxycarbonylbutyl and 2-butoxycarbonylethyl groups, hydroxy lower alkyl groups such as hydroxymethyl, 2-hydroxyethyl and 4-hydroxybutyl groups, di-lower alkylamino lower alkyl groups such as dimethylaminoethyl, diethylaminopropyl and diethylaminobutyl groups cyclic amino lower alkyl groups, preferably where the cyclic amino moiety has 4 to 6 carbon atoms such as 1-pyrrolidinylethyl and 2-pyrrolin-1-ylmethyl groups, and alkenyl groups, preferably having 2 to 4 carbon atoms, such as allyl, 1-propenyl, 1-butenyl and 2-butenyl groups. Examples of aryl groups are a phenyl group, a naphthyl group, alkylphenyl groups such as tolyl and xylyl groups, halophenyl groups such as p-chlorophenyl, p-bromophenyl and 2,4-dichlorophenyl groups and alkoxyphenyl groups such as methoxyphenyl group. At least one of $R_1$ and $R_2$ is a carboxy group-containing alkyl group or a sulfo group-containing alkyl group. As used herein, the terms "lower alkyl", "lower alkoxy", etc., designate groups having 1 to 4 carbon atoms therein.

In the above described general formula, (f) L is a methine group, e.g. —CH= or —C(lower alkyl)= such as —C($CH_3$)= or —C(n—$C_3H_7$)=, (g) X is an inorganic or organic acid anion capable of forming salt with a cyanine dye, e.g. a halide such as chloride, bromide or iodide, p-toluenesulfonate, thiocyanate, sulfamate, perchlorate, fluoroborate, methylsulfonate, ethylsulfonate, fluorosulfonate or 2,4-dinitrobenzenesulfonate and (h) $Z_1$ and $Z_2$, which can be the same or different, each represents the non-metallic atoms necessary for forming a 5-membered and/or 6-membered nitrogen-containing heterocyclic nucleus.

Examples of nitrogen-containing heterocyclic nuclei are thiazole nuclei including substituted and unsubstituted thiazole, benzothiazole and naphthothiazole nuclei, such as thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzothiazole, 5-methoxybenzothiazole, 5-ethoxybenzothiazole, 5-phenylbenzothiazole, 5-carboxybenzothiazole, 5-phenethylbenzothiazole, 5-fluorobenzothiazole, 5-trifluoromethylbenzothiazole, 6-chlorobenzothiazole, 6-bromobenzothiazole, 6-methylbenzothiazole, 6-methoxybenzothiazole, 6-ethoxybenzothiazole, 6-methoxybenzothiazole, 5-methoxynaphtho(2,3-d)thiazole, naphtho(2,1-d)thiazole, naphtho(1,2-d)thiazole, naphtho(2,3-d)thiazole, 5-methoxynaphtho(1,2-d)thiazole, 7-ethoxynaphtho(2,1-d)thiazole, and 8-methoxynaphtho(2,1-d)thiazole, nuclei, oxazole nuclei including substituted and unsubstituted oxazole, benzoxazole and naphthoxazole nuclei, such as oxazole, 4-phenyloxazole, benzoxazole, 5-fluorobenzoxazole, 5-fluorobenzoxazole, 5-hydroxybenzoxazole, 5-carboxybenzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-methoxynaphthoxazole, 6-methylbenzoxazole, 6-chlorobenzoxazole, 6-methoxybenzoxazole, 5,6-dimethylbenzoxazole, naphtho(2,1-d)-oxazole, naphtho(1,2-d)oxazole and naphtho(2,3-d)oxazole nuclei, selenazole nuclei including substituted and unsubstituted selenazole, benzoselenazole and naphthoselenazole nuclei, such as selenazole, 4-methylselenazole, 4-phenylselenazole, benzoselenazole, 5-methylbenzoselenazole, 5-methoxybenzoselenazole, 5-hydroxybenzoselenazole, 5-chlorobenzoselenazole, 6-chlorobenzoselenazole, naphtho(2,1-d)selenazole and naphtho(1,2-d)-selenazole nuclei, thiazoline nuclei including substituted and unsubstituted thiazoline nuclei, such as thiazoline, 4-methylthiazoline and 4-nitrothiazoline nuclei, 2-pyridine nuclei including substituted and unsubstituted pyridine nuclei, such as 2-pyridine and 5-methyl-2-pyridine nuclei, 4-pyridine nuclei including substituted and unsubstituted 4-pyridine nuclei, such as 4-pyridine and 3-methyl-4-pyridine nuclei, imidazole nuclei including substituted and unsubstituted imidazole, benzoimidazole and naphthoimidazole nuclei, such as 1-methylimidazole, 1-ethylimidazole, 1-methyl-4-phenylimidazole, 1-ethyl-4-phenylimidazole, 1-methinebenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho-(1,2-d)imidazole, 1-allyl-5,6-dichlorobenzimidazole, 1-allyl-5-chlorobenzimidazole, 1-phenylbenzimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole and naphtho(2,1-d)imidazole nuclei, quinoline nuclei including substituted and unsubstituted quinoline nuclei, such as quinoline, 6-methylquinoline, 6-methoxyquinoline, 6-ethoxyquinoline, 6-chloroquinoline, 4-methoxyquinoline, 4-methylquinoline, 8-methoxyquinoline, 8-methylquinoline, 4-chloroquinoline and 6-nitroquinoline nuclei and 3,3-dialkylindolenine nuclei including substituted and unsubstituted nuclei, such as 3,3-dimethylindolenine, 3,3-dimethyl-5-chloroindolenine, 3,3-dimethyl-5 or 6-cyanoindolenine, 3,3-diethylindolenine, 3,3-dimethyl-5-methoxyindolenine and 3,3-dimethyl-methylindolenine nuclei.

Methods of synthesizing the sensitizing cyanine dyes used in the present invention are described, for example, in British Pat. 840,223, Japanese Pat. Publication 23467/1965, German Pat. Nos. 929,080, 1,072,467, 1,072,765, 1,163,671 and 1,177,482 U.S. Pat. Nos. 2,503,776, 2,912,329, 3,177,210 and 3,196,017.

Typical examples of these sensitizing dyes having a marked supersensitizing effect are given in the following without intending to limit the invention:

I. Anhydro-5,5'-dichloro-9-ethyl-3,3'-di(3-sulfopropyl)-thiacarbocyanine hydroxide II. Anhydro-5,5'-dichloro-9-ethyl-3,3'-di(3-sulfobutyl)-thiacarbocyanine hydroxide III. Anhydro-5,5'-dimethyl-9-ethyl-3,3'-di(3-sulfopropyl)thiacarbocyanine hydroxide IV. Anhydro-9-ethyl-3,3'-di(3-sulfopropyl)-4,5,4',-5'-dibenzothiacarbocyanine hydroxide V. Anhydro-9-ethyl-3,3'-di(3-sulfopropyl)-4',5'-benzothiacarbocyanine hydroxide VI. 3-Ethyl-9-methyl-3'-(4-carboxybutyl)thiacarbocyanine bromide VII. Anhydro-3-ethyl-9-methyl-3'-(3-sulfobutyl)-thiacarbocyanine hydroxide VIII. Anhydro-5,5'-dimethyl-3,3'-di(3-sulfopropyl)-selenacarbocyanine hydroxide IX. Anhydro-9-methyl-3,3'-di(3-sulfopropyl)-4,5,4',5'-dibenzothiacarbocyanine hydroxide X. Anhydro-1,3'-diethyl-5,5'-dichloro-3-(3-sulfopropyl)-benzimidazoloxacarbocyanine hydroxide XI. Anhydro-9-ethyl-3,3'-(3-sulfopropyl)-5,5'-dichlorobenzoxacarbocyanine hydroxide XII. Anhydro-9-ethyl-3,3'-(3-sulfopropyl)-5,5'-diphenylbenzoxacarbocyanine hydroxide XIII. Anhydro-1,1'-diethyl-3,3'-(3-sulfopropyl)-5,5',6,6'-tetrachlorobenzimidacarbocyanine hydroxide The benzothiazoles, benzothiazolones, naphthothiazoles and naphthothiazolones used in the present invention are represented by the following formulas (II*a*) and (II*b*), for example,

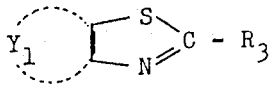

(IIa)

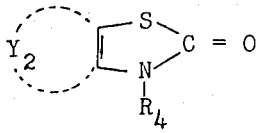

(IIb)

in which $Y_1$ and $Y_2$ each represents a non-metallic atomic group necessary for forming a benzene nucleus or a naphthalene nucleus which can, for example, be substituted with halogen atoms such as chlorine, lower alkyl groups such as methyl and ethyl groups, lower alkoxy groups such as a methoxy and ethoxy groups, hydroxyl groups and aryl groups such as a phenyl group, $R_3$ represents a hydrogen atom, a lower alkyl group such as a methyl or ethyl group, a halogen atom such as a chlorine atom, a lower alkoxy group such as a methoxy group, an aralkyl group such as a phenethyl group, a lower alkyl carbonyl group such as a methylcarbonyl group or a hydroxy group, and $R_4$ represents a lower alkyl group such as a methyl or ethyl group. The terms "lower alkyl" etc. as used herein are as hereinbefore described. Specific examples of these compounds are given below without intending to limit the invention:

A. Benzothiazole
B. 2-Methylbenzothiazole
C. 2,4-Dimethylbenzothiazole
D. 2-Chlorobenzothiazole
E. 5-Chloro-2-methylbenzothiazole
F. 2-Methoxybenzothiazole
G. 2-Acetoxybenzothiazole
H. 2-(β-Phenethyl)benzothiazole
I. 2-Methyl-β-naphthothiazole

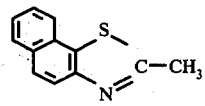

J. 2-Ethyl-β-naphthothiazole
K. 2-Benzothiazole
L. 3-methyl-2-benzothiazole
M. 3-Ethyl-2-benzothiazole The quinolones used in the present invention are 2(1)-quinolones, for example, represented by the following general formula (III),

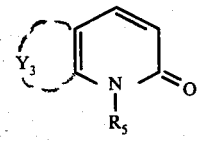

(III)

in which $Y_3$ represents a non-metallic atomic group necessary for forming a benzene nucleus which can be substituted with one or more of the same substituents as those described with respect to $Y_1$ and $Y_2$ and $R_5$ represents a hydrogen atom or a lower alkyl group (e.g., having 1 to 4 carbon atoms) such as a methyl or ethyl group.

Examples of these quinolones are given in the following without intending to limit the invention:

a. 2-Quinolinol
b. N-Methyl-2-quinolinol
c. N-Ethyl-2-quinolinol
d. 1,6-Dimethyl-2-quinolinol
e. 1-Ethyl-6-methyl-2-quinolinol
f. 1-Ethyl-6-hydroxy-2-quinolinol
g. 1-Methyl-6-methoxy-2-quinolinol
h. 1-Ethyl-6-methoxy-2-quinolinol
i. 4-Methyl-2-quinolinol
j. 4-Methyl-6-methoxy-2-quinolinol The methods of synthesizing the benzothiazoles, etc., and quinolones used in the present invention are described, for example, in Beilstein, Vol. 27 including the first and second supplement volumes, J. Prakt. Chem. Vol. 14, p 139–149 (1961) and British Pat. No. 885,520.

A feature of the supersensitizing effect attained according to the invention is that the sensitization takes place markedly in a shorter wavelength region as compared with the sensitization in the J-Band sensitization wavelength region, which can be obtained by only a sensitizing cyanine dye in which the substituent on the N-position of the heterocyclic ring is an unsubstituted alkyl group and differs from the sensitization in the J-Band region only.

The amount of the sensitizing dye employed according to the invention is generally about 10 to 300 mg, preferably 10 to 100 mg, per 1 kg of the silver halide emulsion independently of the use of the supersensitizing agent and can be varied with the formulation of the emulsion and the end-use purpose. Addition of the dye to the emulsion can be carried out in a known manner, for example, by dissolving the dye in a water-miscible organic solvent, for example, an alcohol such as methanol or ethanol, a ketone such as acetone, an ether such as methyl cellosolve or a nitrogen-containing aromatic compound such as pyridine and then adding the solution of the dye to the emulsion. The dye can be added at any step of the process of preparing the emulsion, but, in general, it is desirable to add the dye directly before completion of the chemical ripening.

The quantity of the benzothiazole, the quinolone or mixture thereof used as a supersensitizing agent is generally about 0.5 to 5 g per 1,000 ml of the silver halide emulsion, but can be varied with the formulation of the emulsion, the end-use purpose thereof and the kind of sensitizing dye used in combination. The supersensitizing agent can be added to the emulsion simultaneously with the sensitizing dye or before the addition of the sensitizing dye. Two or more supersensitizing agents can be used in combination. Furthermore, the supersensitizing agent can also be added as it is or after dissolving the supersensitizing agent in a water-miscible solvent such as methanol or ethanol, and the supersensitizing agent can be added at any step of the process of preparing the emulsion with one or more sensitizing dyes, but, in general, it is desirable to add the supersensitizing agent to the emulsion which has been subjected to washing with water and chemical ripening.

The silver halide photographic emulsion used in the present invention can be prepared in a conventional manner, and includes silver chloride, silver chlorobromide, silver bromide, silver iodobromide, silver chloroiodide and silver chlorobromoiodide precipitated using the single jet method, double jet method or a combination of these methods and then ripened. Preferred silver halides are silver chloroiodobromide, preferably, having a halogen composition of about 5 to 90 mol %, preferably 5 to 30 mol % bromide and about 0.1 to 5 mol %, preferably 0.2 to 1 mol % iodide, and silver chlorobromide. The average grain size of these silver halide emulsions is preferably about 0.04 to 2 $\mu$ when measured using the projected area method and expressed as a number average.

The crystal shape or crystal habit of the silver halide used in the invention is not particularly limited. However, the instant invention is particularly useful for the sensitization of silver halide grains having a (III) surface as well as grains having a (100) surface, which are well known in the art. The invention is also useful for the sensitization of irregular grains, of course, and particularly useful for the sensitization of regular grains of silver chlorobromide and silver chlorobromoiodide having a (100) surface which are ordinarily used for lithographic films.

The above described silver halide emulsions can be obtained by controlling the conditions when preparing the silver halide grains using the twin jet procedure. That is to say, the silver halide grains can be prepared by adding simultaneously a water-soluble silver salt such as silver nitrate and a water-soluble halide, for example, an alkali metal halide such as potassium bromide to an aqueous solution of a colloid for silver halide such as gelatin, acylated gelatins or other protein-type colloids, the aqueous solution being rapidly stirred. Suitable methods of preparing silver halide emulsions having a desirable uniform grain size and crystal habit are described, for example, in "Ia; Properties of Photographic Emulsion Grains" J. Phot. Sci., 12 (1964) page 242–251; "The Spectral Sensitization of Silver Bromide Emulsion on Different Crystallographic Faces" J. Phot. Sci., 13 (1965) page 85–89; "Studies on Silver Bromide Sols Part I, The Formation and Ageing of Monodispersed Silver Bromide Sols" J. Phot. Sci., 13 (1965) page 98–103; and "Studies on Silver Bromide Sols Part II, The Effect of Additives on the Sol Particles" J. Phot. Sci., 13 (1965) page 104–107.

The silver halide photographic emulsion of the present invention can be subjected to conventionally used chemical ripening methods, for example, gold sensitization (as described, for example, in U.s. Pat. Nos. 2,540,085, 2,597,856, 2,597,915 and 2,399,083), sensitization with Group VIII metal ions (as described, for example, in U.S. Pat. Nos. 3,445,235, 3,537,858, 3,023,102 and 2,717,833; British Pat. No. 707,704), sulfur sensitization (as described, for example, in U.S. Pat. Nos. 1,574,944, 2,278,947, 2,440,206, 2,410,689, 3,189,458 and 3,415,649), reduction sensitization (as described, for example, in U.S. Pat. Nos. 2,518,698, 2,419,974 and 2,983,610) and a combination of these methods.

Specific examples of chemical sensitizers are sulfur sensitizers such as allyl thiocarbamide, thiourea, sodium thiosulfate and cystine, noble metal sensitizers such as potassium chloroaurate, gold thiosulfate and potassium chloroplatinate and reduction sensitizers such as stannous chloride and phenylhydrazine. Furthermore, the photographic emulsion of the invention can contain polyoxyethylene derivatives, polyoxypropylene derivatives, derivatives having quaternary ammonium groups, fog inhibitors such as nitrobenzimidazole and ammonium chloroplatinate, stabilizers such as 4-hydroxy-6-methyl-1,3,3a,7-tetrazaindene, hardeners such as formaldehyde, chrome alum, 1-hydroxy-3,5-dichlorotriazine sodium, glyoxal and dichloroacrolein (as described, for example, in U.S. Pat. Nos. 3,288,775, 3,017,280 and 2,983,611 and British Pat. No. 1,167,207) and coating aids such as saponin and sodium alkylbenzenesulfonates (as described, for example, in U.S. Pat. Nos. 2,600,831, 3,068,101 and 3,415,649).

Where the silver halide photographic emulsion of the invention is used for color photographic materials, color couplers such as those described in U.S. Pat. Nos. 2,376,679, 2,322,027, 2,801,171, 2,698,794, 3,227,554, 3,046,129, 3,415,652, 3,311,476, 3,408,194, 3,006,759, 3,458,315, 3,277,155, 3,214,437 and 3,253,924, and dispersing agents can be incorporated in the emulsion.

The silver halide photographic emulsion of the invention can include as a protective colloid one or more of gelatin, acylated gelatins such as phthalated gelatin and malonated gelatin, cellulose compounds such as hydroxyethyl cellulose and carboxymethyl cellulose, soluble starches such as dextrin, hydrophilic polymers such as polyvinyl alcohol, polyvinylpyrrolidone, polyacrylamide and polystyrenesulfonic acid, usual plasticizers for dimensional stabilization, latex polymers and matting agents.

The finished emulsion is coated on a suitable support which has no adverse influence upon the photographic properties, for example, baryta papers, resin-coated papers, synthetic papers, triacetate films, polyethylene terephthalate films, glass sheets and other photograpic supports well known in the art.

The silver halide photographic light-sensitive material obtained according to the present invention exhibits a strong sensitization property as well as an excellent photographic property where there are little fog and dye contamination.

The present invention is suitable for not only systems supersensitized with only one of the above described cyanine dyes but also systems supersensitized with combinations of the cyanine dyes. These systems are, for example, described in Japanese Pat. Publication 4936/1968 and U.S. Pat. Nos. 2,533,427, 2,688,545, 2,701,198, 2,751,298, 2,973,264, 3,173,791, 3,364,031, 3,527,641, 3,679,428 and 3,814,689. Moreover, the present invention is also effective in other systems wherein the cyanine dyes of the invention are used together with sensitizing dyes described in U.S. Pat. Nos. 2,430,558, 2,483,748, 2,497,876, 2,519,001, 3,567,458 and 3,837,862 and Japanese Pat. application No. 88196/1973.

The silver halide photographic emulsion of the invention is useful for various light-sensitive materials, for example, light-sensitive materials for the graphic arts such as lithographic films, black-and-white negative light-sensitive materials and color negative light-sensitive materials such as light-sensitive materials for general negatives and light-sensitive materials for television use, color papers, color positive films, color reversal films, 8 mm color films, other spectrographic light-sensitive materials, astrophotograpic light-sensitive materials, aerial photographic high resolving power light-sensitive materials and light-sensitive materials for diffusion transfer.

The following non-limiting examples are given in order to illustrate the invention in greater detail. Unless otherwise indicated, all parts, percents, ratios and the like are by weight.

EXAMPLE 1

To 1 kg of a silver chlorobromoiodide emulsion (iodide content: 0.25 mol %; bromide content: 20 mol %) was added a predetermined quantity of a sensitizing dye as shown in Table 1 and spectrally sensitized. On the other hand, using the same emulsion and a predetermined quantity of the same sensitizing dye, a predetermined quantity of the supersensitizing agent of the invention as shown in Table 1 was added in the form of a methanol solution to prepare a spectrally supersensitized emulsion. These emulsions were coated onto supports of triacetate films and dried to obtain photographic light-sensitive materials each having a thickness of 5 $\mu$ on dry basis.

Using an actinometer having a light source of a color temperature of 5,400° K, these photographic materials were subjected to optical wedge exposure (one-twentieth second) through a red filter (Wratten No. 25), a green filter (Wratten No. 58) or a blue filter (Wratten No. 47B). Using a spectrograph of the diffraction grating type having a tungsten light source of a color temperature of 2666° K, on the other hand, exposure was carried out for one-fifth second to obtain a spectrogram.

The thus exposed light-sensitive materials were developed with a developer having the following composition at 20° C for 2 minutes, followed by stopping, fixing and washing with water, thus obtaining strips each having a predetermined black-and-white image. Then this image was subjected to measurement of the density using a S-Type Desitometer manufactured by the Fuji Photo & Film Co., thus obtaining a red filter sensitivity (SR), a green filter sensitivity (SG), a blue filter sensitivity (SB) and a fog value. The results obtained are shown in Table 1 as a relative value with the standard point of the optical density, by which the sensitivity was determined, being [Fog + 0.20].

| Composition of Developer | | |
|---|---|---|
| Water | | 500 ml |
| Metol | | 2 g |
| Sodium Sulfite | | 40 g |
| Hydroquinone | | 4 g |
| Sodium Carbonate (monohydrate) | | 28 g |
| Potassium Bromide | | 1 g |
| Water | to | 1000 ml |

An equal volume of water was added when this developer was used. The designations of the sensitizing dyes and benzothiazoles in Table 1 correspond to the designations hereinbefore of the chemical structures used for typical examples in this specification.

Table 1

Figure 1:
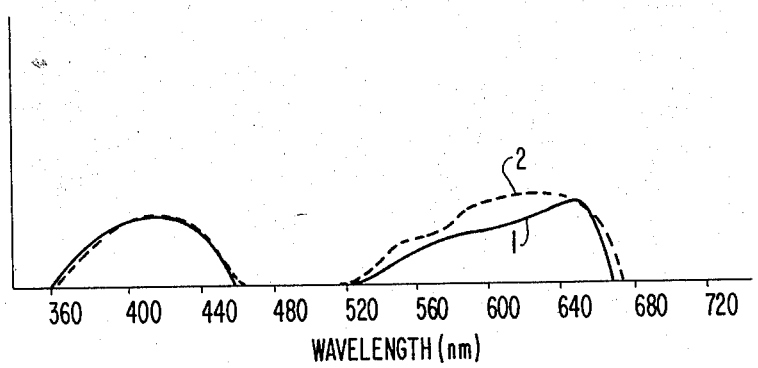
FIGS. 1 to 8 show the spectrograms of photographic emulsions.
Figure 2:
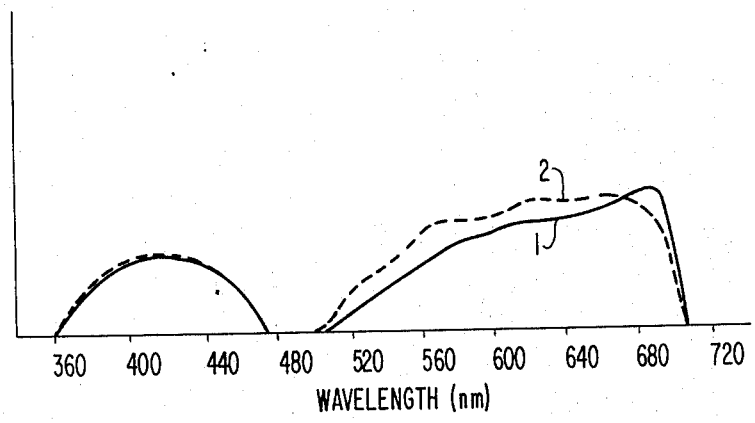
Figure 3:
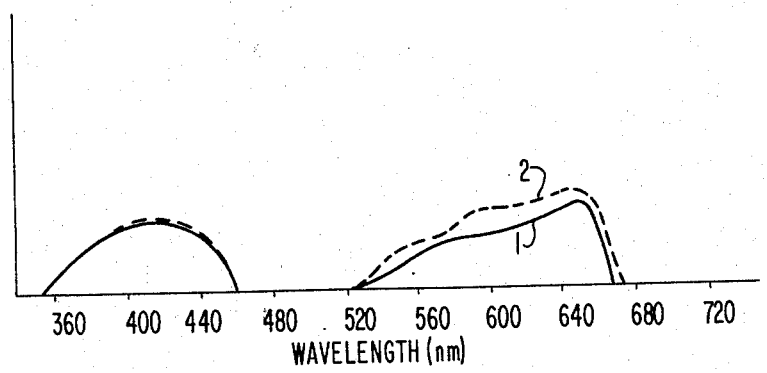

| Run No. | Sensitizing Dye (x $10^5$ mol/kg emulsion) | | Benzothiazole (g/kg emulsion) | | Spectral Sensitivity (Relative Value) SR | SG | SB | Fog Density | Spectrogram |
|---|---|---|---|---|---|---|---|---|---|
| 1 | (I) | 10 | | — | 100* | 100* | 100* | 0.04 | Fig. 1-1 |
| | " | 10 | A | 0.5 | 150 | 180 | 105 | 0.04 | |
| | " | 10 | " | 1.0 | 140 | 170 | 110 | 0.04 | Fig. 1-2 |
| | " | 10 | B | 0.5 | 150 | 170 | 100 | 0.05 | |
| | " | 10 | " | 7.0 | 140 | 160 | 100 | 0.04 | |
| 2 | (III) | 15 | | — | 100* | 100* | 100* | 0.05 | |
| | | 15 | B | 0.5 | 130 | 150 | 105 | 0.04 | |
| | | 15 | " | 1.0 | 140 | 150 | 95 | 0.05 | |
| | | 15 | D | 0.5 | 140 | 160 | 100 | 0.04 | |
| | | 15 | " | 1.0 | 150 | 160 | 105 | 0.04 | |
| 3 | (IV) | 16 | | — | 100* | 100* | 100* | 0.04 | Fig. 2-1 |
| | | 16 | C | 0.5 | 160 | 170 | 105 | 0.05 | Fig. 2-2 |
| | | 16 | " | 1.0 | 150 | 160 | 110 | 0.04 | |
| | | 16 | I | 0.5 | 160 | 170 | 105 | 0.04 | |
| | | 6 | " | 1.0 | 170 | 180 | 100 | 0.04 | |
| 4 | (IX) | 15 | | — | — | 100* | 100* | 0.04 | |
| | | 15 | A | 0.5 | — | 130 | 120 | 0.04 | |
| | | 15 | " | 1.0 | — | 120 | 120 | 0.05 | |
| | | 15 | I | 0.5 | — | 130 | 130 | 0.04 | |
| | | 15 | " | 1.0 | — | 130 | 120 | 0.04 | |
| 5 | (I) | 10 | | — | 100* | 100* | 100* | 0.04 | Fig. 3-1 |
| | " | 10 | a | 0.5 | 140 | 170 | 105 | 0.04 | |

Table 1-continued

Figure 4:
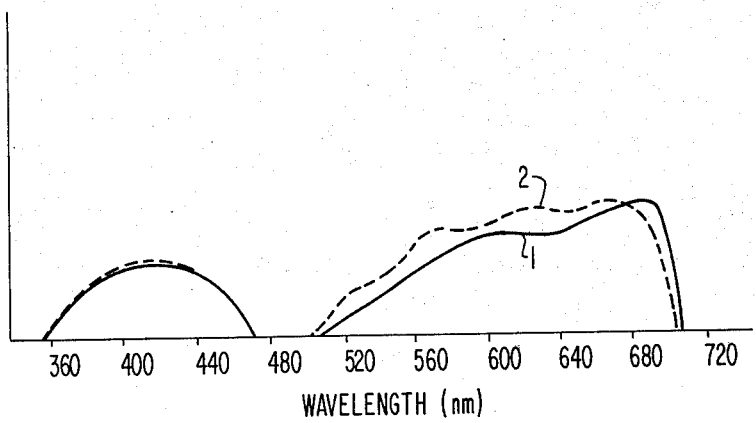

| Run No. | Sensitizing Dye (x $10^5$ mol/kg emulsion) | | Benzothiazole (g/kg emulsion) | | Spectral Sensitivity (Relative Value) SR | SG | SB | Fog Density | Spectrogram |
|---|---|---|---|---|---|---|---|---|---|
| | " | 10 | " | 1.0 | 150 | 180 | 110 | 0.05 | Fig. 3-2 |
| | " | 10 | c | 0.5 | 150 | 160 | 100 | 0.05 | |
| | " | 10 | " | 1.0 | 150 | 170 | 105 | 0.04 | |
| 6 | (III) | 15 | | — | 100* | 100* | 100* | 0.04 | |
| | | 15 | b | 0.5 | 140 | 160 | 110 | 0.04 | |
| | | 15 | " | 1.0 | 140 | 160 | 105 | 0.04 | |
| | | 15 | d | 0.5 | 150 | 170 | 100 | 0.05 | |
| | | 15 | " | 1.0 | 150 | 170 | 100 | 0.04 | |
| 7 | (IV) | 6 | | — | 100* | 100* | 100* | 0.05 | Fig. 4-1 |
| | | 6 | c | 0.5 | 170 | 180 | 95 | 0.04 | |
| | | 6 | " | 1.0 | 170 | 190 | 100 | 0.05 | Fig. 4-2 |
| | | 6 | i | 0.5 | 160 | 180 | 100 | 0.06 | |
| | | 6 | " | 1.0 | 170 | 180 | 105 | 0.05 | |
| 8 | (IX) | 15 | | — | — | 100* | 100* | 0.04 | |
| | | 15 | a | 0.5 | — | 130 | 120 | 0.04 | |
| | | 15 | " | 1.0 | — | 120 | 120 | 0.04 | |
| | | 15 | i | 0.5 | — | 130 | 120 | 0.05 | |
| | | 15 | " | 1.0 | — | 130 | 130 | 0.04 | |

*Standard

It is apparent from the results shown in Table 1 that the combinations of the invention result in a marked supersensitizing effect without an increase of fog and dye contamination. As shown in FIG. 2 and FIG. 3, the supersensitizing effect is marked in the shorter wavelength region than the sensitization maximum wavelength obtained by the use of a sensitizing dye only.

EXAMPLE 2

1 g each of an emulsion containing regular grains of silver chlorobromide having a crystal habit of a (100) surface (bromide content: 20 mol %) was prepared. To one of these emulsions was added only a predetermined quantity of a sensitizing dye as shown in Table 2, while to the other were added the same sensitizing dye and a predetermined quantity of a benzothiazole as shown in Table 2. These emulsions were respectively applied to cellulose triacetate film supports and dried to obtain photographic materials. The resulting photographic light-sensitive materials were subjected to sensitometry in an analogous manner to Example 1, and the spectral sensitivities and spectrograms were obtained.

The sensitizing dyes used were Dyes IV and VIII and Comparative Dyes 1 and 2, as described below, the benzothiazole was Compound B and the quinolone was Compound b.

Dye (1)

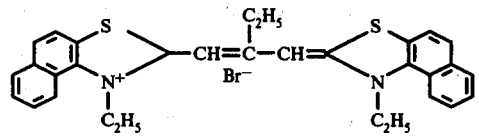

Dye (2)

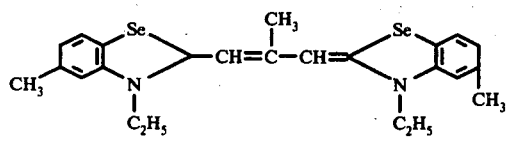

TABLE 2

Figure 5:
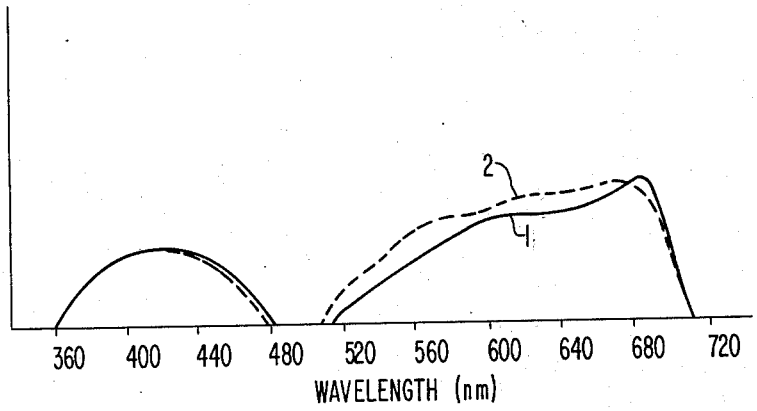
Figure 6:
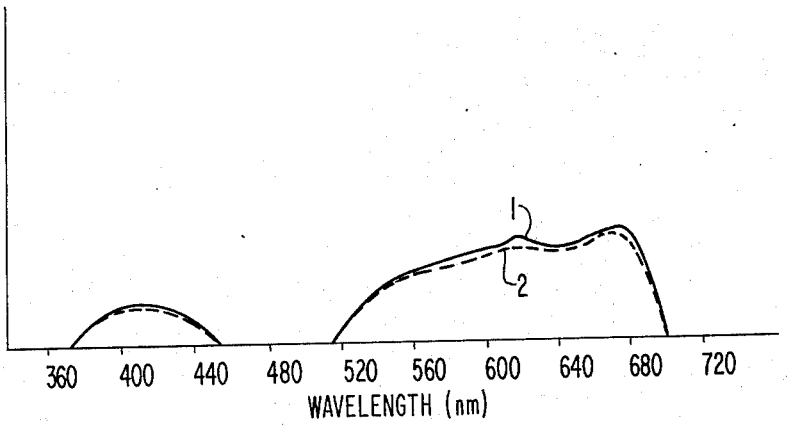

| Run No. | Sensitizing Dye (× $10^5$ mol/kg emulsion) | | Compound** (g/kg emulsion) | Spectral Sensitivity (Relative Value) SR | SG | SB | Fog Density | Spectrogram |
|---|---|---|---|---|---|---|---|---|
| 1 | (IV) | 8 | — | 100* | 100* | 100* | 0.04 | Fig. 5-1 |
| | (IV) | 8 | 0.5 | 150 | 160 | 100 | 0.04 | Fig. 5-2 |
| | (1) | 8 | — | 80 | 80 | 90 | 0.06 | Fig. 6-1 |
| | (1) | 8 | 0.5 | 70 | 80 | 90 | 0.06 | Fig. 6-2 |
| 2 | (VI) | 10 | — | 100* | 100* | 100* | 0.05 | |
| | (VI) | 10 | 0.5 | 120 | 140 | 100 | 0.05 | |
| | (2) | 10 | — | 80 | 80 | 90 | 0.05 | |
| | (2) | 10 | 0.5 | 80 | 90 | 90 | 0.05 | |
| 3 | (IV) | 8 | — | 100* | 100* | 100* | 0.04 | Fig. 7-1 |
| | (IV) | 8 | 0.5 | 160 | 180 | 100 | 0.04 | Fig. 7-2 |
| | (1) | 8 | — | 80 | 80 | 80 | 0.06 | Fig. 8-1 |
| | (1) | 8 | 0.5 | 90 | 80 | 80 | 0.06 | Fig. 8-2 |
| 4 | (VIII) | 10 | — | 100* | 100* | 100* | 0.05 | |

TABLE 2-continued

| Run No. | Sensitizing Dye (× $10^5$ mol/kg emulsion) | | Compound** (g/kg emulsion) | Spectral Sensitivity (Relative Value) SR | SG | SB | Fog Density | Spectrogram |
|---|---|---|---|---|---|---|---|---|
| | (VIII) | 10 | 0.5 | 130 | 140 | 95 | 0.05 | |
| | (2) | 10 | — | 70 | 80 | 90 | 0.06 | |
| | (2) | 10 | 0.5 | 80 | 90 | 90 | 0.05 | |

*Standard;
**Compound (B) in Run No. 1–2 and Compound (b) in Run 3.

As is evident from the results shown in Table 2 and the spectrograms of FIG. 4 and FIG. 5, there is a clear difference in supersensitizing effect between the sensitizing dyes of the invention and the comparative dyes and Dyes IV and VIII in which the N-aliphatic groups are sulfo group-containing alkyl groups give more marked supersensitizing effects and higher spectral sensitivities with lower fog densities as compared with Comparative Dyes 1 and 2.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing the combination of (i) at least one cyanine dye represented by the General Formula I,

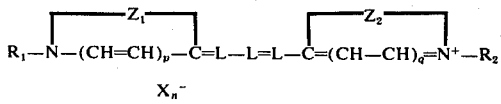

wherein $Z_1$ and $Z_2$, which can be same or different, each represents the non-metallic atoms necessary for forming a 5-membered or 6-membered nitorgen-containing heterocyclic nucleus selected from the group consisting of the thiazole nucleus, oxazole nucleus, selenazole nucleus, thiazoline nucleus, 2-pyridine nucleus, 4-pyridine nucleus, imidazole nucleus, quinoline nucleus and 3,3-dialkylindolenine nucleus; $R_1$ and $R_2$, which can be the same or different, each represents an aliphatic group or an aromatic group, at least one of which is an alkyl group having a sulfo group, L represents a methine group; X represents an anion; $n$ is 0 or 1; $p$ is 0 or 1; and $q$ is 0 or 1; and (ii) at least one substantially colorless nitrogen-containing heterocyclic organic base selected from the group consisting of a benzothiazole, a benzothiazolone, a naphthothiazole, a naphthothiazolone and a quinolone, in a quantity sufficient to supersensitize; the benzothiazole, benzothiazolone, naphtholthiazole, and naphthothiazolone are represented by General Formulas (IIa) or (IIb)

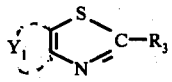

(IIa)

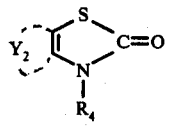

(IIb)

wherein $Y_1$ and $Y_2$ each represents a non-metallic atomic group necessary for forming a benzene nucleus of a naphthalene nucleus; $R_3$ represents a hydrogen atom, a lower alkyl group, a halogen atom, a lower alkoxy group, an aralkyl group, a lower alkylcarbonyl group, or a hydroxy group; and $R_4$ represents a lower alkyl group; the quinoline is represented by the General Formula III

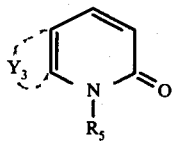

(III)

wherein $Y_3$ represents a non-metallic atomic group necessary for forming a benzene nucleus; and $R_5$ represents a hydrogen atom or a lower alkyl group.

2. The silver halide photographic emulsion of claim 1, wherein the silver halide consists mainly of grains having a (100) surface.

3. The silver halide photographic emulsion of claim 1, wherein at least one of the substituents on the nitrogen atoms in the heterocyclic nuclei of the cyanine dye is a sulfo group-containing alkyl group.

4. The silver halide photographic emulsion of claim 1, wherein the silver halide is silver chlorobromide or silver chlorobromoiodide.

5. The silver halide photographic emulsion of claim 1, wherein the heterocyclic organic base is benzothiazole, 2-methylbenzothiazole, benzothiazolone or 3-methylbenzothiazolone.

6. The silver halide photographic emulsion of claim 1, wherein the quinolone is 2-quinolinol, 1-ethyl-2-quinolinol, 1,6-dimethyl-2-quinolinol or 4-methyl-2-quinolinol.

7. The silver halide photographic emulsion of claim 1, wherein the cyanine dye is anhydro-5,5′-dichloro-9-ethyl-3,3′-di(3-sulfopropyl)thiacarbocyanine hydroxide or anhydro-9-ethyl-3,3′-di(3-sulfopropyl)-4,5,4′,-5′-dibenzothiacarbocyanine hydroxide.

8. A photographic material comprising a support having thereon the silver halide photographic emulsion of claim 1.

* * * * *